US006357363B1

(12) United States Patent
Miltaru

(10) Patent No.: US 6,357,363 B1
(45) Date of Patent: Mar. 19, 2002

(54) RAILROAD TANK CAR

(75) Inventor: Daniel V. Miltaru, Portland, OR (US)

(73) Assignee: Gunderson, Inc., Portland, OR (US)

( * ) Notice: Subject to any disclaimer, the term of this patent is extended or adjusted under 35 U.S.C. 154(b) by 0 days.

(21) Appl. No.: 09/553,090

(22) Filed: Apr. 19, 2000

(51) Int. Cl.[7] ..... B61D 5/06
(52) U.S. Cl. ..... 105/362; 105/358; 105/360
(58) Field of Search ..... 105/358, 360, 105/362, 451, 359, 361, 421

(56) References Cited

U.S. PATENT DOCUMENTS

| | | | | | |
|---|---|---|---|---|---|
| 2,907,284 | A | * | 10/1959 | Folmsbee | 105/360 |
| 3,308,769 | A | * | 3/1967 | Halcomb et al. | 105/362 |
| 3,336,879 | A | * | 8/1967 | Halcomb | 105/358 |
| 3,487,532 | A | | 1/1970 | Phillips | 29/416 |
| 3,631,815 | A | * | 1/1972 | Heap et al. | 105/358 |
| 3,645,213 | A | | 2/1972 | Taylor | |
| 4,284,012 | A | * | 8/1981 | Hrinsin | 105/362 |
| 4,466,356 | A | * | 8/1984 | Messersmith et al. | 105/358 |
| 4,805,540 | A | * | 2/1989 | Mundloch et al. | 105/358 |
| 5,159,882 | A | * | 11/1992 | Krug et al. | 105/362 |
| 5,329,859 | A | | 7/1994 | Culligan et al. | 105/416 |
| 5,351,625 | A | * | 10/1994 | Culligan et al. | 105/362 |
| 5,467,719 | A | * | 11/1995 | Dalrymple et al. | 105/362 |
| 6,196,135 | B1 | * | 3/2001 | Kashima et al. | 105/392.5 |

FOREIGN PATENT DOCUMENTS

| | | | |
|---|---|---|---|
| CH | 535 671 | 7/1980 | B61F/1/100 |
| DE | 1 530 095 | 7/1970 | B61F/1/02 |
| DE | 20 34 511 | 1/1972 | B61D/17/00 |
| DE | 28 54 744 | 7/1980 | B61D/5/04 |
| DE | 40 37 014 A1 | 5/1992 | B61D/1/08 |
| EP | 0 389 866 B1 | 9/1993 | B61D/5/06 |
| EP | 0 389 867 B1 | 5/1994 | B61D/5/06 |
| EP | 0 526 894 B1 | 11/1994 | B61F/1/10 |
| FR | 2634440 A1 | 7/1988 | B61D/5/06 |
| FR | 2 669 287 B1 | 6/1991 | B61D/5/06 |
| FR | 2 670 453 A1 | 6/1991 | B61D/5/00 |
| GB | 997837 | 7/1965 | |
| GB | 1089851 | 11/1967 | G61D/5/04 |
| GB | 1483176 | 8/1999 | |
| IT | 01 25 711 | 5/1995 | |

* cited by examiner

*Primary Examiner*—S. Joseph Morano
*Assistant Examiner*—Lars A. Olson
(74) *Attorney, Agent, or Firm*—Chernoff, Vilhauer, McClung & Stenzel LLP

(57) ABSTRACT

A railway tank car of light weight and high cargo load capacity in which a tank shell structure is carried on and unified with an underframe including a stub sill at each end, a pair of spaced apart saddle bolsters, each joined to a respective one of the stub sills, and a center sill interconnecting the saddle bolsters. The tank shell rests on and is welded to the center sill, the saddle bolsters, and the stub sills, so that the tank shell is an integral part of the car, and both static and dynamic load forces resulting from train operation and from cargo loads are shared by the tank and the underframe. The underframe is constructed primarily of welded flat plate, with a minimum of specially formed parts and difficult welds, in order to simplify and minimize the costs of construction.

20 Claims, 9 Drawing Sheets

RAILROAD TANK CAR

BACKGROUND OF THE INVENTION

The present invention relates to improvements in railroad tank cars, and in particular to such a car with reduced car weight, and having integrated and unified load-bearing structures so that dynamic train loads and static loads are shared between the tank itself and the underframe portion of the structure of the tank car.

Many railway tank cars have completely separate underframes with tank support structures mounted on the underframes and tank bodies attached to the support structures. While such cars have ample strength it is desired to provide tank cars of lighter weight, since a car whose tare weight is less can carry greater weights of cargo and thus generate greater amounts of revenue using a given amount of fuel.

A type of tank car structure used extensively in North America has a stub sill supported by a wheeled truck attached to each end of a tank. The structure of the tank supports itself between the stub sills, carrying not only the static and dynamic loads resulting from the weight and movement of liquid cargo contained in the tank, but also dynamic loads resulting from operation of the car as part of a train. In such cars forces are concentrated in and carried through the locations where the stub sills are attached to the tank. As a result, such cars all too frequently are subject to structural failure during train operation.

A type of tank car structure used widely on European railroads utilizes a relatively heavy underframe including a substantial longitudinal frame structure upon which are carried saddles to support a tank. Cargo loads are transferred to the underframe of such a car by the saddle structures alone, and a relatively massive center sill structure, separate from the tank, is utilized to carry most dynamic train loads. Such cars are significantly heavier than is desired, for a given liquid cargo weight capacity.

Another result of such a structural design is that the end portions of the underframe of such a car have to be of relatively heavy construction in order to permit the car when loaded to be supported on jacks located at the corners of the underframe, since there is a relatively long lever arm between the corners of the underframe and the saddle attachment locations, where the weight of the tank and included cargo is transferred to the underframe.

A further deficiency of such a railroad tank car design is that the structures of the tanks and the underframes of the cars do not cooperate with each other to carry dynamic loads during operation of such cars as part of a train.

What is needed, then, is an improved railroad tank car of reliably durable construction but lighter in weight than previously known cars. Additionally, it is desired for such a car to be able to be assembled with a minimum of special skill requirements and a minimum of requirements for formed metal parts included in such a car's structure.

SUMMARY OF THE INVENTION

The present invention provides a railroad tank car structure which answers the aforementioned need for a tank car of ample strength and durability combined with lighter car weight and simple construction, by providing a car in which the tank shell and underframe components are better integrated into a unified, strong, and light structure than has previously been accomplished.

In one preferred embodiment of the present invention a railroad tank car includes a pair of transversely extending saddle bolsters interconnected by a center sill structure, and a stub sill extends outward longitudinally from each saddle bolster. A tank is closely supported by the saddles of the saddle bolsters. The tank also rests atop and is fastened, preferably welded, to the center sill and to each stub sill, so that the stub sills, saddles, tank, and center sill are a unified structure and cooperate closely to carry the static loads imposed by the weight of cargo carried in the tank and the dynamic loads that result from operation of a train including such a car and its cargo.

In one embodiment of the present invention each saddle is connected with the tank over a significant portion of the outside of the tank and provides support for the tank against atomospheric "vacuum pressure" in the case of improper venting of the tank during discharge.

In one preferred embodiment of the present invention the interconnection of the tank with the stub sills, saddle bolsters, and center sill includes the use of doubler plates that carry and distribute forces among the various portions of the tank car through structure of great enough size that critical force concentrations are avoided, while the car's weight is reduced.

In a preferred embodiment of the invention doubler plates are designed to function as linear stiffeners in transition zones between joints.

In one embodiment of the invention stub sills, saddle bolsters, and a center sill are constructed primarily by welding flat steel plate parts so that construction of such a car is uncomplicated.

In one embodiment of the present invention the stub sills include torsion box structures interconnecting the bottom plate and top shear plate of the stub sill and providing ample stiffness in the stub sill.

In one embodiment of the invention a portion of the tank located longitudinally outward from the saddle bolsters rests atop and is fastened to the top shear plate of the stub sill.

In a preferred embodiment of the invention, each stub sill includes a coupler tube capable of accepting either European hook-and-link couplers or North American type automatic knuckle couplers and associated cushioning devices.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
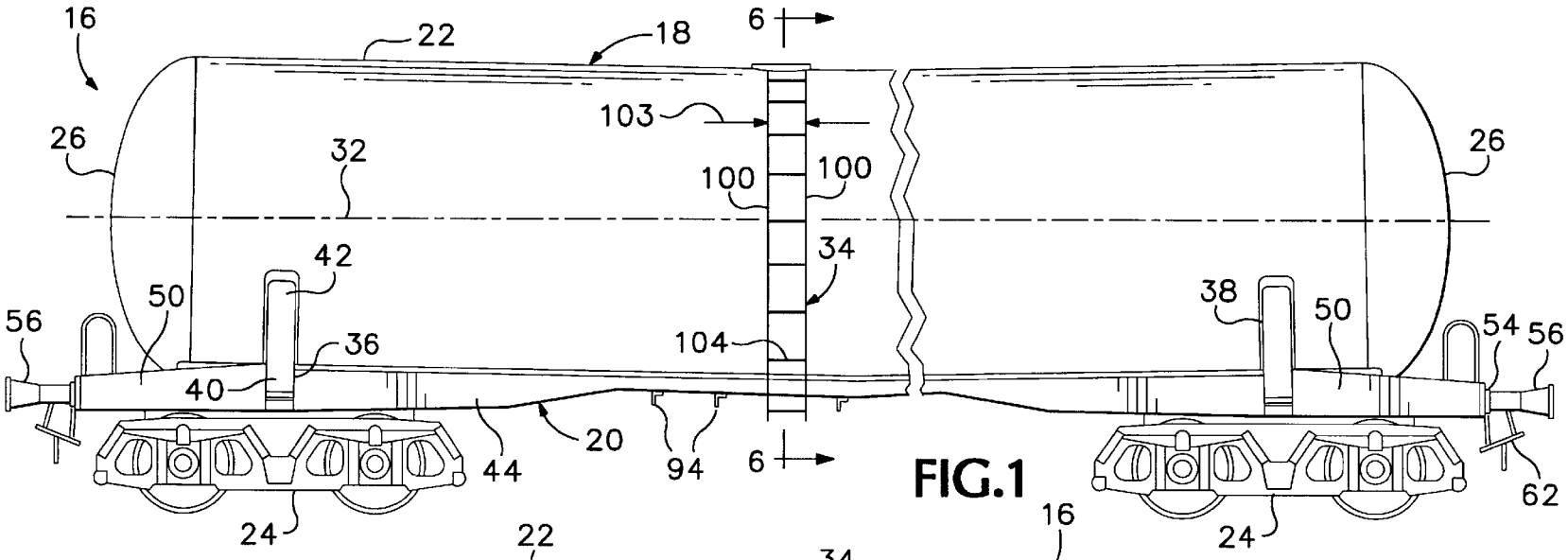
FIG. 1 is a side elevational view of a railroad tank car embodying the present invention.
Figure 5:
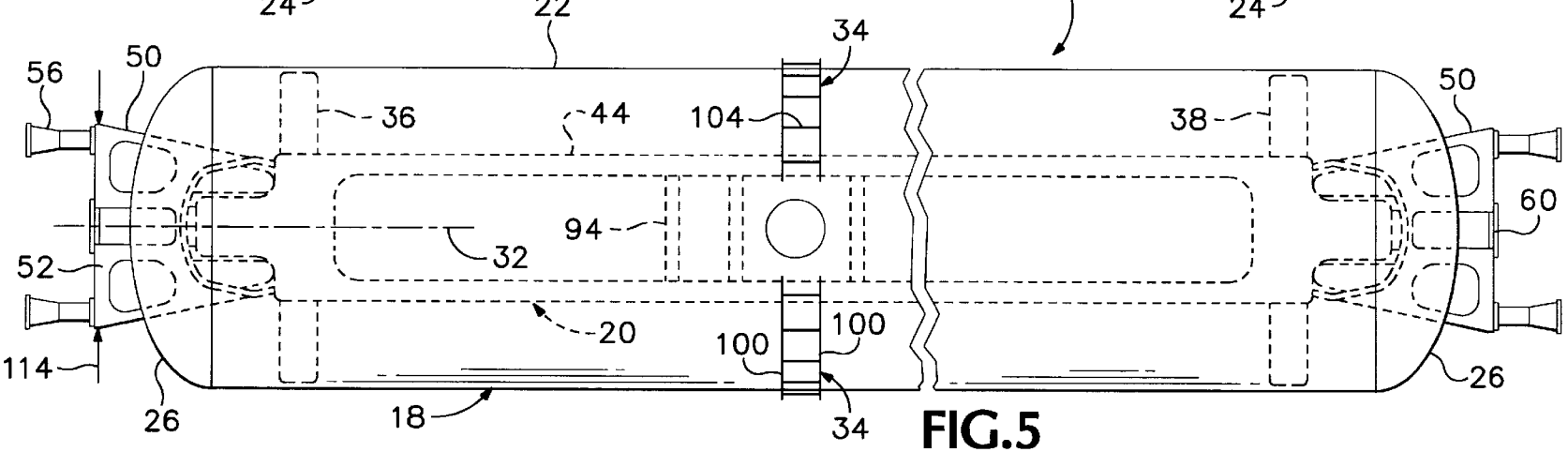
FIG. 5 is a top plan view of the car shown in FIG. 1.
Figure 2:
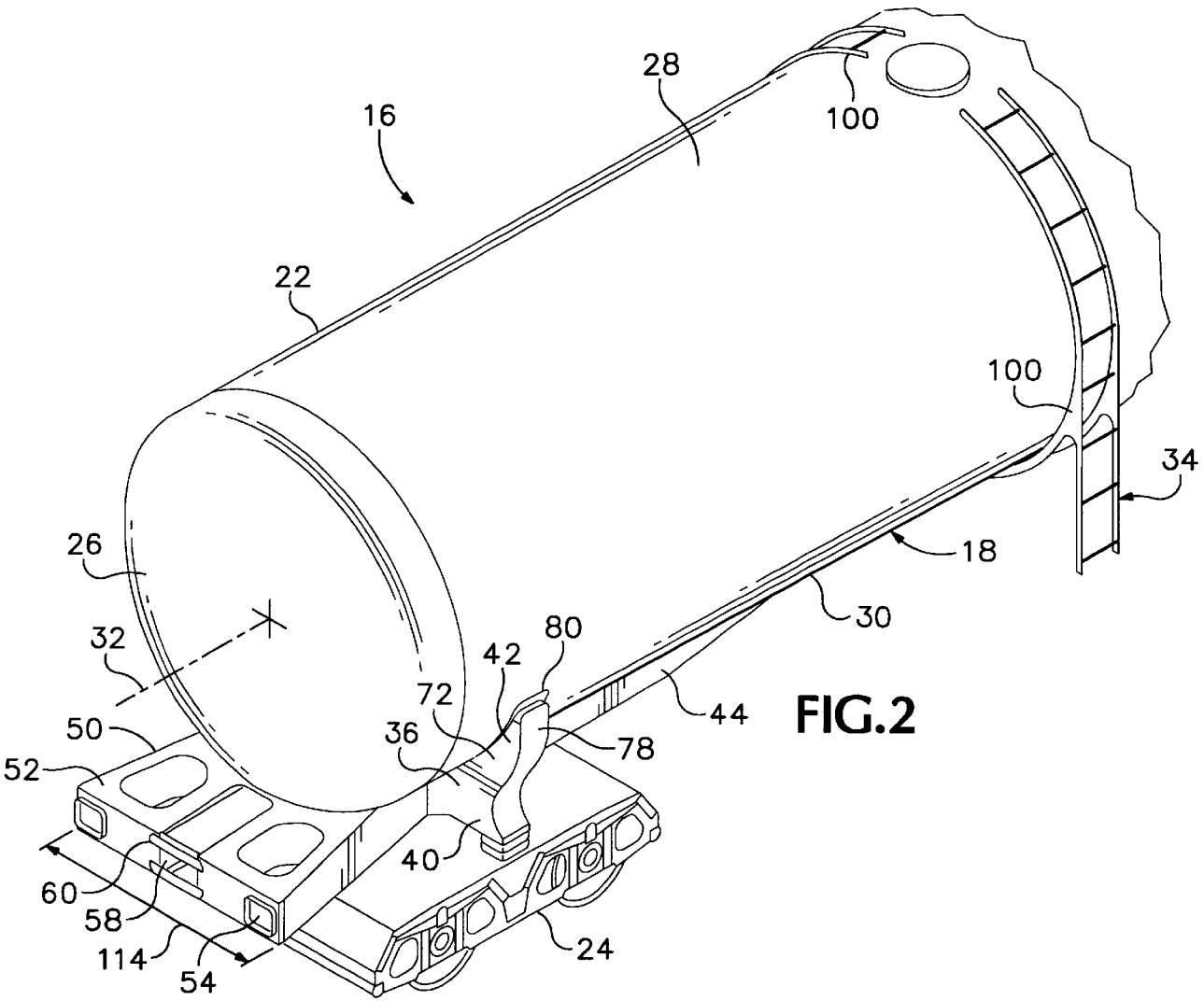
FIG. 2 is an isometric view of the car shown in FIG. 1, taken from above and to one side of an end of the car.

Referring now to the drawings which form a part of the disclosure herein, a tank car 16 which is one preferred embodiment of the present invention includes a substantially unitized body 18 including an underframe portion 20 and a tank 22, supported on a pair of wheeled trucks 24, as may be seen in FIGS. 1 and 2.

Figure 3:
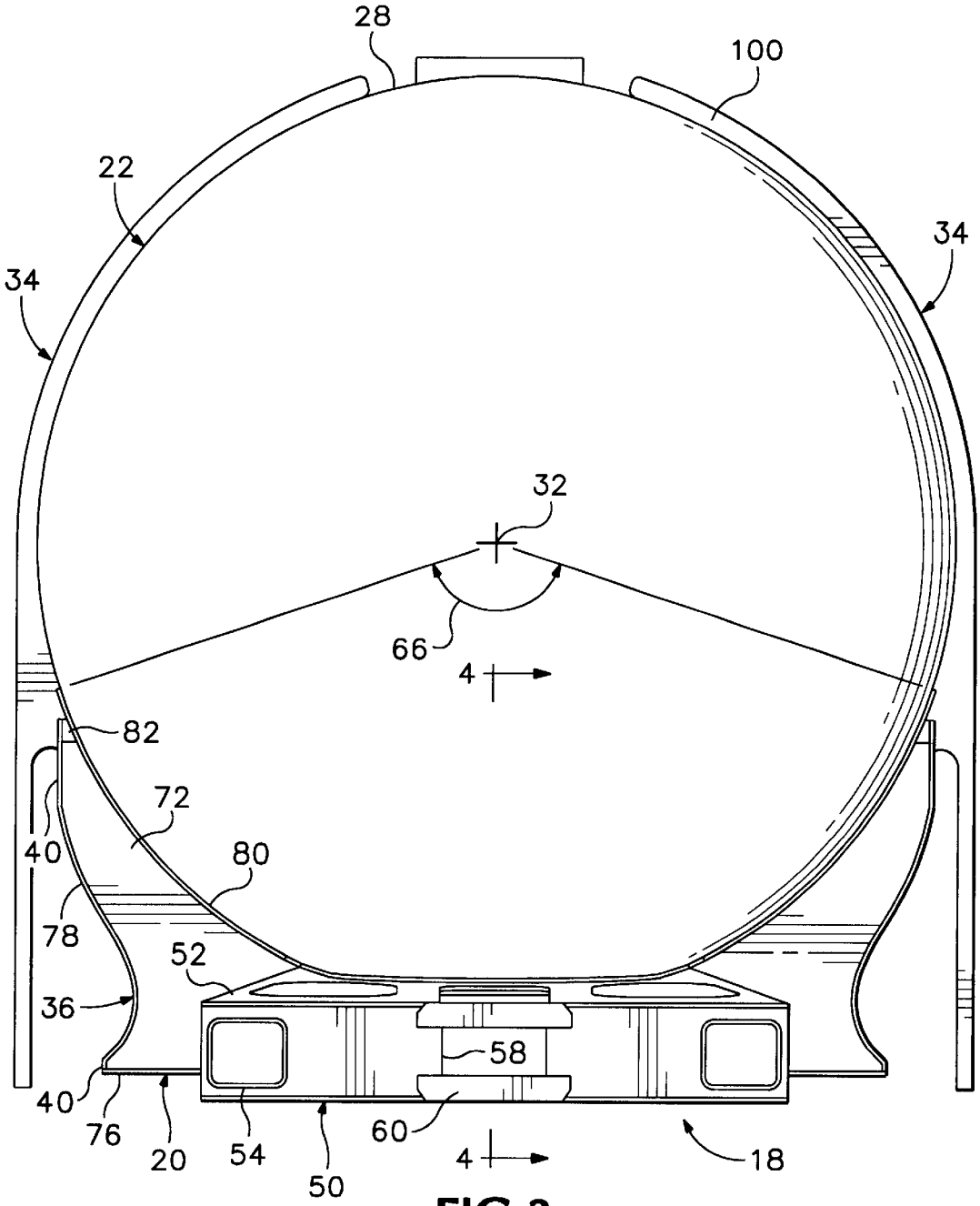
FIG. 3 is an end elevational view of the body of the car shown in FIG. 1.

The tank 22 includes a pair of opposite ends 26, a top 28 and a bottom 30, seen in FIG. 3. The tank has two generally cylindrical halves joined together at the midpoint of the length of the car, and defines generally a longitudinal central axis 32. The two longitudinal halves of the tank 22 are inclined downward slightly toward the mid-portion of the car body 18, at an angle of, for example, about 1° from horizontal, to provide for drainage. A pair of ladders 34 extend upwardly on opposite sides of the tank 22 toward its top 28.

The underframe 20 includes a pair of saddle bolsters 36 and 38, each located centrally above a conventional center bearing for the respective one of the trucks 24. Each of the saddle bolsters 36 and 38 includes a transverse lower portion 40 including a location for a foundation on each side of the car 16 for a respective side bearing for the respective truck 24. Each saddle bolster 36 and 38 extends upwardly, and includes a concave saddle portion 42 that fits matingly against and is welded to a lower portion of the tank 22.

Extending longitudinally of the car between the saddle bolsters 36 and 38 is a center sill 44. The ends of the center sill 44 are welded to the saddle bolsters 36 and 38, and the center sill 44 also is welded to the bottom 30 of the tank 22 along its entire span between the saddle bolsters 36 and 38.

Attached to the longitudinally outward side of each of the saddle bolsters 36 and 38 is a respective stub sill 50 whose top shear plate 52 rests against and is welded to a portion of the bottom 30 of the tank 22, adjacent a respective one of the ends 26, so that the tank 22 is connected closely with and supported by the saddle bolsters 36, the center sill 44, and the stub sills 50.

At an outer end of each stub sill 50 are a pair of buffer foundations 54 and conventional buffers 56, as well as a centrally located coupler housing or tube 58, with a conventional striker plate 60. The coupler tube 50 is thus configured to accept either the conventional European hook-and-link type coupler as shown at 62 in FIG. 1 or an automatic coupler (not shown) including a cushioning device.

Figure 4:
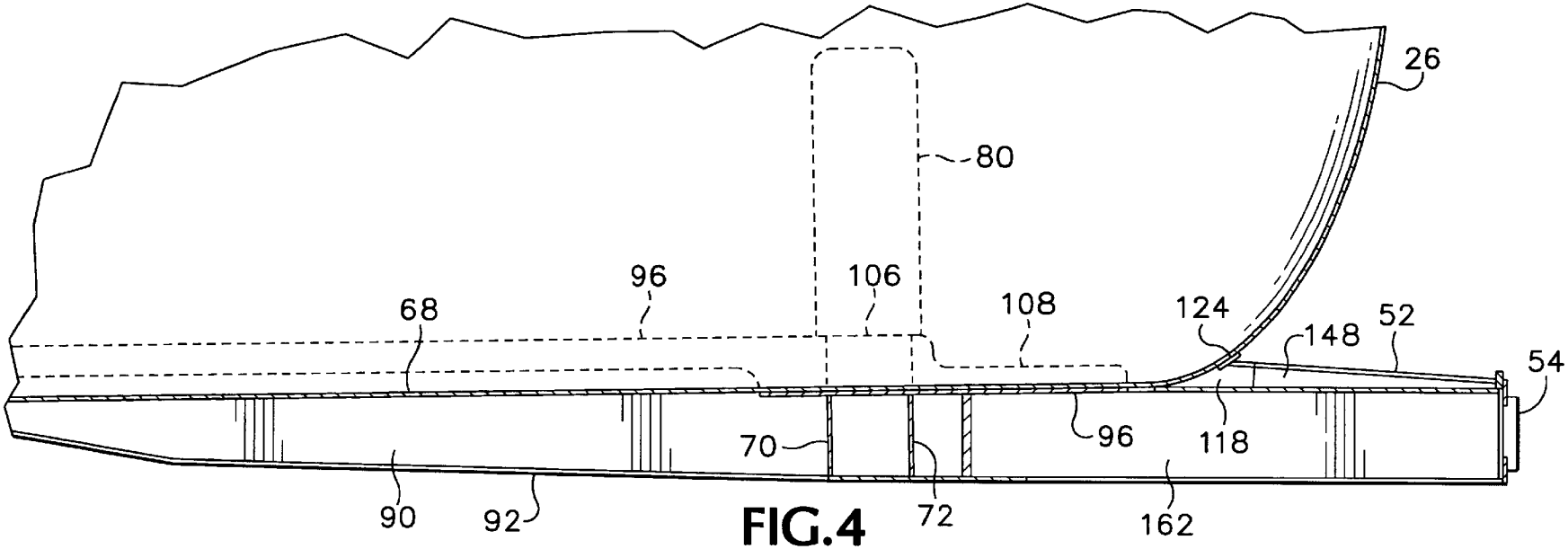
FIG. 4 is a sectional view, at an enlarged scale, of a portion of the car shown in FIG. 1, taken along line 4—4 of FIG. 3.

As shown in FIGS. 2, 3, and 4, the saddles 42 extend upward in intimate contact with the outside of the tank 22 on each side of the car body 18, subtending an angle 66 about the central axis 32, preferably in the range of 110–140°, thus giving lateral and vertical support to unify the tank 22 with the underframe 20, and also providing structural support for the skin or shell 68 of the tank 22.

The saddle bolsters 36 and 38 are substantially identical with each other, each including a pair of similar transversely and vertically extending flat plates, an inner plate 70 and a longitudinally outer plate 72 which may be of steel with a thickness of 4.5 mm. The plates 70 and 72 are spaced apart from each other along the length of the car body 18 by a distance 74, center-to-center, of 340 mm. Because of relevant regulations in some localities, and for adequate strength, the distance 74 should be in the range of 300 to 360 mm. A bottom closing plate 76, a side closing plate 78, and a saddle doubler plate 80 extend along and are welded to respective margins of the inner and outer plates 70 and 72 of the saddle bolsters 36 and 38. The bottom plate 76 preferably has a thickness of 8 mm, while the side closing plate 78 may be 4–5 mm thick and the doubler plate 80 may be 4–6 mm thick. A U-shaped closer piece 82 of similar material interconnects the upper margins of the inner and outer plates 70 and 72 with each other and with the side closing plate 78 and the doubler plate 80 at each upper end of the saddle portion 42.

The saddle doubler plate 80 extends longitudinally of the car beyond the inner and outer plates 70 and 72 and also extends upward along the respective side of the tank 22 beyond the inner and outer plates 70 and 72 by an overlap distance 84 of at least 15 mm, and preferably about 50–75 mm, in order to reinforce the shell 68 of the tank 22 and provide an amply large area of interconnection between the doubler plates 80 and the shell 68, and the doubler plates 80 are welded to the shell 68 around their outer margins.

Extending from each saddle bolster 36 or 38 toward the center portion of the car 16, the length of the center sill 44 includes a pair of parallel upright webs 90 each welded to the inner plate 70 of each saddle bolster and extending longitudinally of the car body 18. A narrow transversely extending bottom flange member 92 extends along and is welded to the bottom margin of each of the webs 90 and may be of steel plate about 18 mm thick and about 100 mm wide, for example. Cross tie members 94 may be of angle stock and are welded to the bottom flanges 92, extending between and tying together the webs 90, parallel with the width 95 of the center sill 44, as shown in FIGS. 1, 3, 5 and 10.

Figure 6:
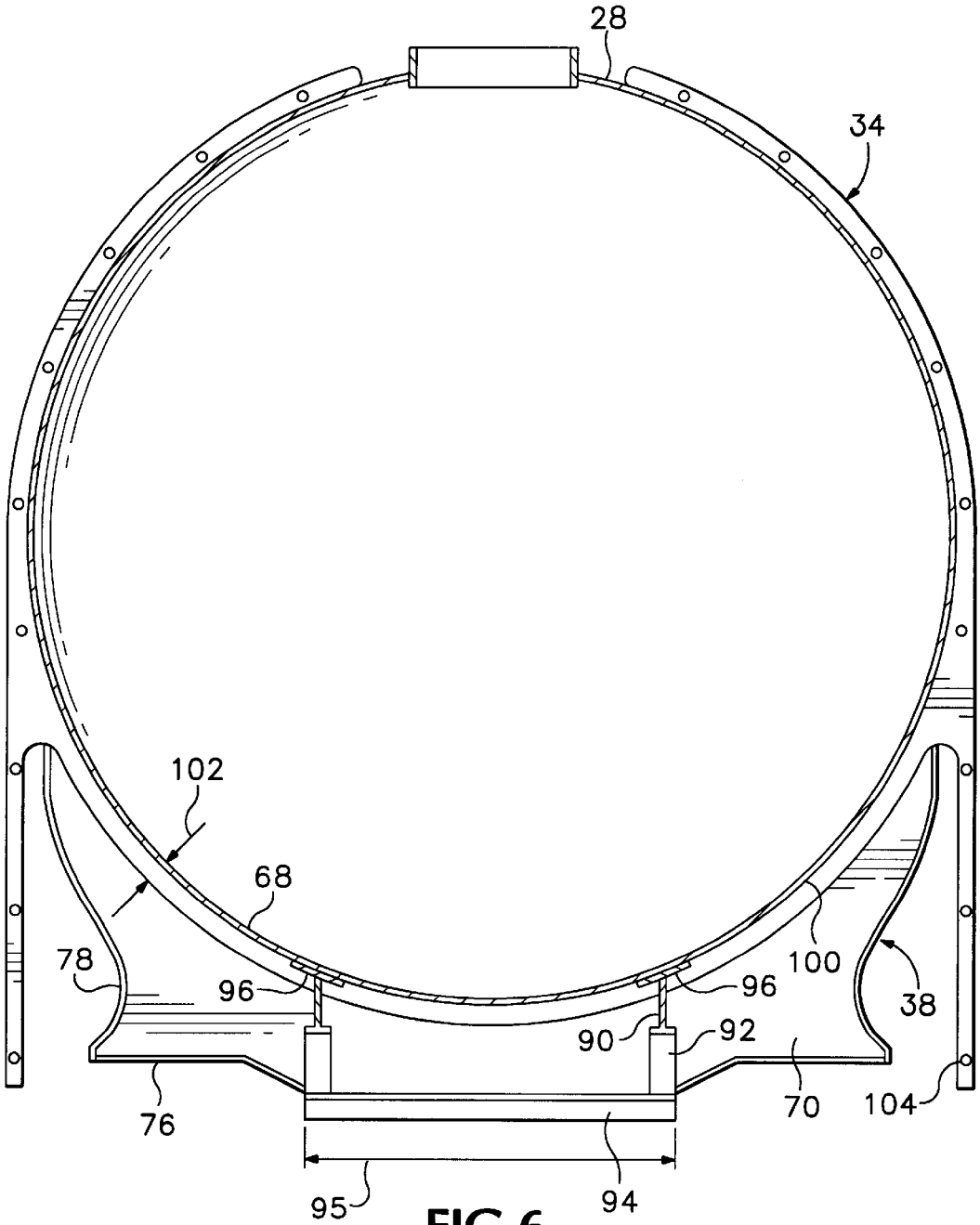
FIG. 6 is a section view of the body of the car shown in FIG. 1, taken along line 6—6, at an enlarged scale.

A respective portion of a tank bottom doubler plate 96 is welded to an upper margin of each web 90. The tank bottom doubler plate 96 also extends along and is welded to the bottom 30 of the tank 22 and is therefore formed into a partial cylinder to fit matingly against the outer surface of the bottom 30 of the tank 22. The tank doubler plate 96 thus acts as a part of the center sill 44 and also interconnects the center sill 44 with the shell 68 over a significant area of the bottom 30. As may be seen in FIGS. 1 and 6, the webs 90 of the center sill are of shallower depth in the longitudinally central portion of the car body 18 than closely adjacent the saddle bolsters 36 and 38.

The ladders 34 extend from and include portions of a pair of rings 100 each extending around the shell 68 of the tank 22 near mid-length of the tank 22. The rings 100 are preferably of steel plate, each having a thickness of about 6 mm and a radial depth or width 102 of about 75 mm. The two rings 100 are spaced apart from each other longitudinally of the car body 18 by a distance 103 of about 40 cm, for example, appropriate to act as the rails of the ladder 34, and are interconnected with each other by the several rungs 104 of the ladders 34. Each of the rings 100 is welded to the shell 68 of the tank 22, so that the pair of rings 100 act cooperatively to provide radial support and stiffening for the shell 68 of the tank 22, to help it to withstand atmospheric pressure in case of insufficient venting during emptying of cargo from the tank 22.

Figure 7:
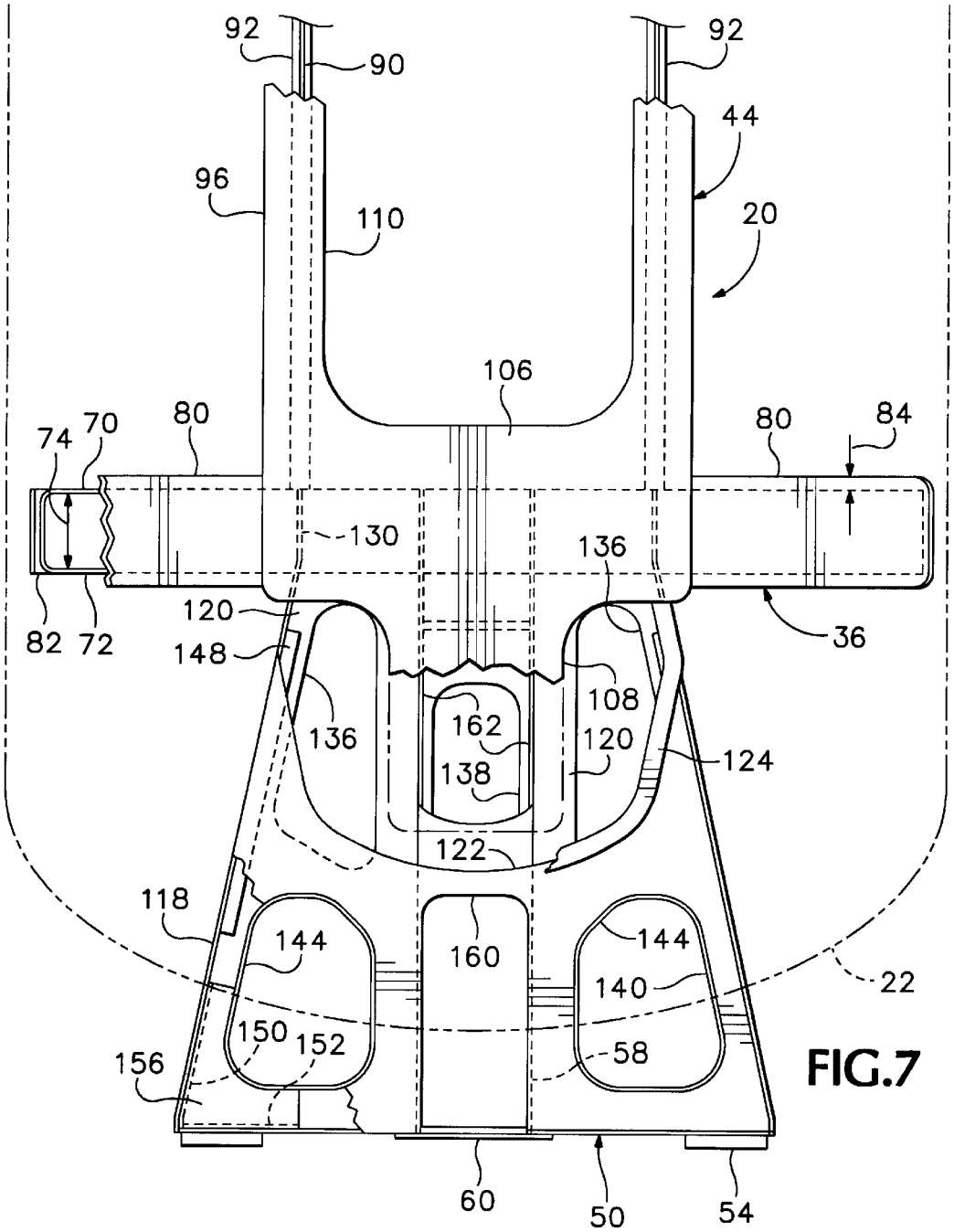
FIG. 7 is a top plan view, at an enlarged scale, of the transversely extending saddle bolster the stub sill structure, and a portion of the center sill structure of the car shown in FIG. 1, with a portion of the tank shown in broken line.
Figure 8:
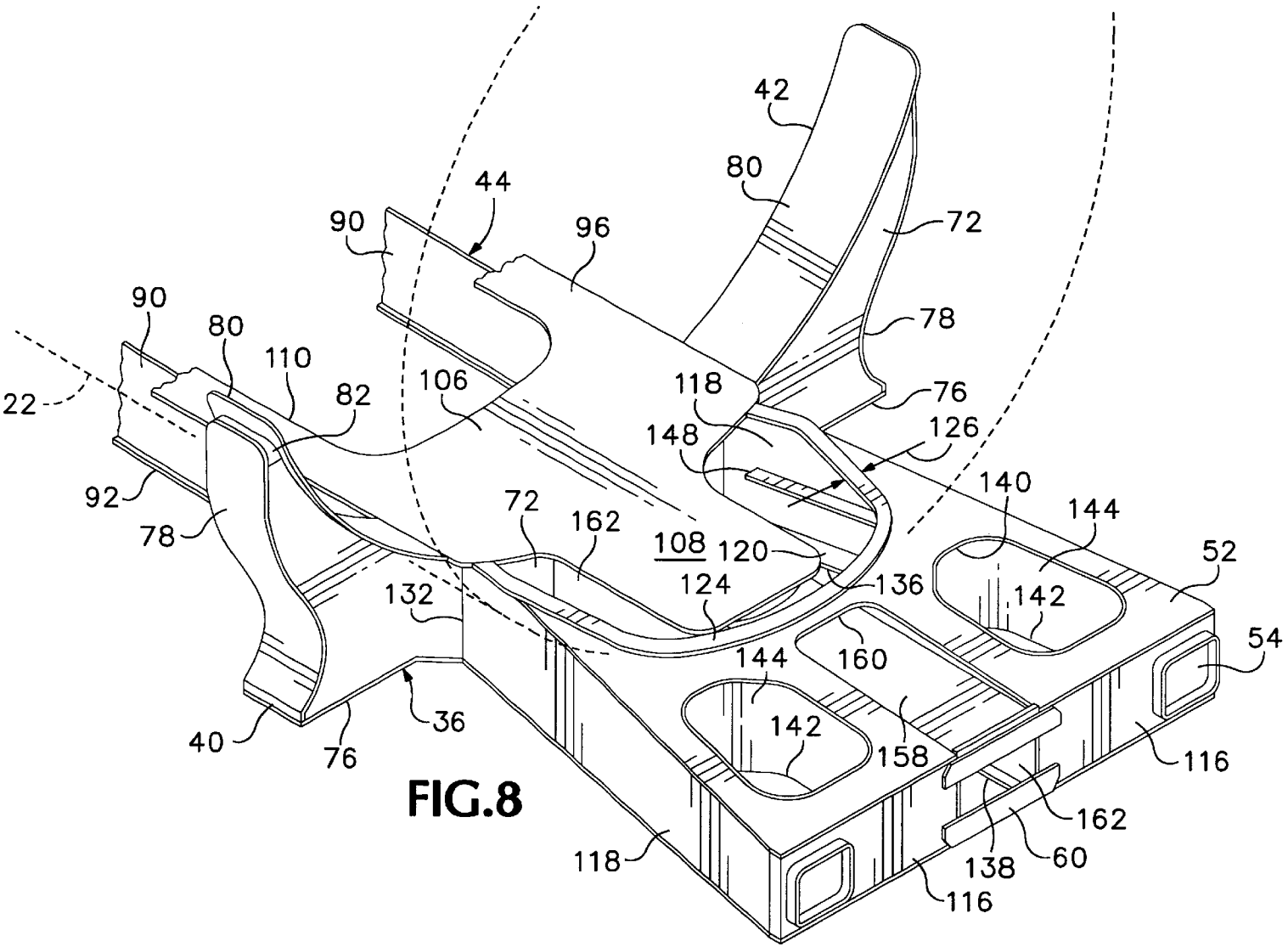
FIG. 8 is an isometric view of the structures shown in FIG. 7, with a portion of the tank shown in broken line, as seen from near one end of the car body.

Referring now also to FIGS. 7 and 8, it will be seen that a full-width portion 106 of the tank bottom doubler plate 96 extends across and is welded to the center part of the upper margins of the vertical transverse plates 70 and 72 of the saddle 42, interconnecting the closer or bottom ends of the saddle doubler plates 80 with each other, and interconnecting the upper margins of the plates 70 and 72. A narrower end portion 108 of the doubler plate 96 extends longitudinally outward away from the saddle portion 42 of the saddle bolsters and is closely in contact with and welded along its margins to the outside of the shell 68 of the tank 22. The doubler plate 96 thus carries forces between the shell 68 of the tank 22, the inner and outer plates 70 of the saddle, and the webs 90 of the center sill. A large opening 110 is defined in the tank bottom doubler plate 96 between the parallel webs 90 of the center sill, at a distance 112 longitudinally inward from the inner plate 70, leaving a solid portion of the tank bottom doubler plate 96 adjacent the inner plate 70 large enough to spread the forces transmitted between the shell 68 and the saddle bolster 36 or 38 over a safely large area of the tank shell 68.

Referring to FIGS. 2, 3, 4, 5, 7, and 8, each stub sill 50 is generally trapezoidal in plan shape, having a maximum width 114 greater than the width 95 of the center sill and extending longitudinally outward from the outer plate 72 of the adjacent saddle bolster 36 or 38. The stub sill 50 includes a pair of upright end plates 116 located on opposite sides of the coupler tube 58 and extending transversely, supporting the buffer foundations 54. A pair of upstanding sideplates 118 extend generally longitudinally and diverge obliquely apart from the outer plate 72 of the saddle bolster 36 or 38 to a corner of the stub sill 50 adjacent a respective one of the end plates 116. The top shear plate 52 extends along and is welded to an upper margin of each of the sideplates 118 and to an upper margin of each of the end plates 116. A bottom plate 120 extends generally horizontally along respective bottom margins of the sideplates 118 and the end plates 116 and is securely welded to the sideplates 118 and end plates 116, as well as to the striker plate 60. The bottom plate 120 butts into and is welded to the margin of the bottom plate 76, which serves as a foundation for a conventional center bearing (not shown) to support the car body 18 on the trucks 24.

The sideplates 118 are tapered in height from a greatest height adjacent the outer plate 72 to a smaller height adjacent the end plates 116 at the longitudinally outer end of the stub sill 50. The top shear plate 52 is thus inclined upward at a shallow angle from the upper margin of the end plates 116 toward the bottom 30 of the tank 22 adjacent the end 26. The sideplates 118 may be of steel plate having a thickness of 4–6 mm. The bottom plate 120 may be of steel with a thickness of 6 mm.

The top shear plate 52 has an inboard margin 122 shaped to correspond matingly with the surface of the bottom 30 of the tank 22 and the bottom portion of its end 26. A narrow doubler plate 124 extends along, and is welded to, a portion of the upper margin of each side plate 118, the inner margin 122 of the top shear plate 52, and respective portions of the upper margins of the sideplates 118, as well as being welded to the outside of the shell 68 of the tank 22, so that the tank 22 is securely fastened to the stub sill 50. The doubler plate 124 may have a thickness of 4.5 mm and a width 126 of 60 mm, to spread the forces transferred between the shell 68 of the tank 22, the top shear plate 52, and the sideplates 118 over an area safely large enough to avoid dangerous concentrations of stress in the attachment of the tank 22 to the underframe 20. Thus, the structures of the stub sill 50, the tank 22, and the saddle bolster 36 or 38 are integrated by interconnection with each other over areas sufficient to avoid excessive concentrations of stresses.

Figure 9:
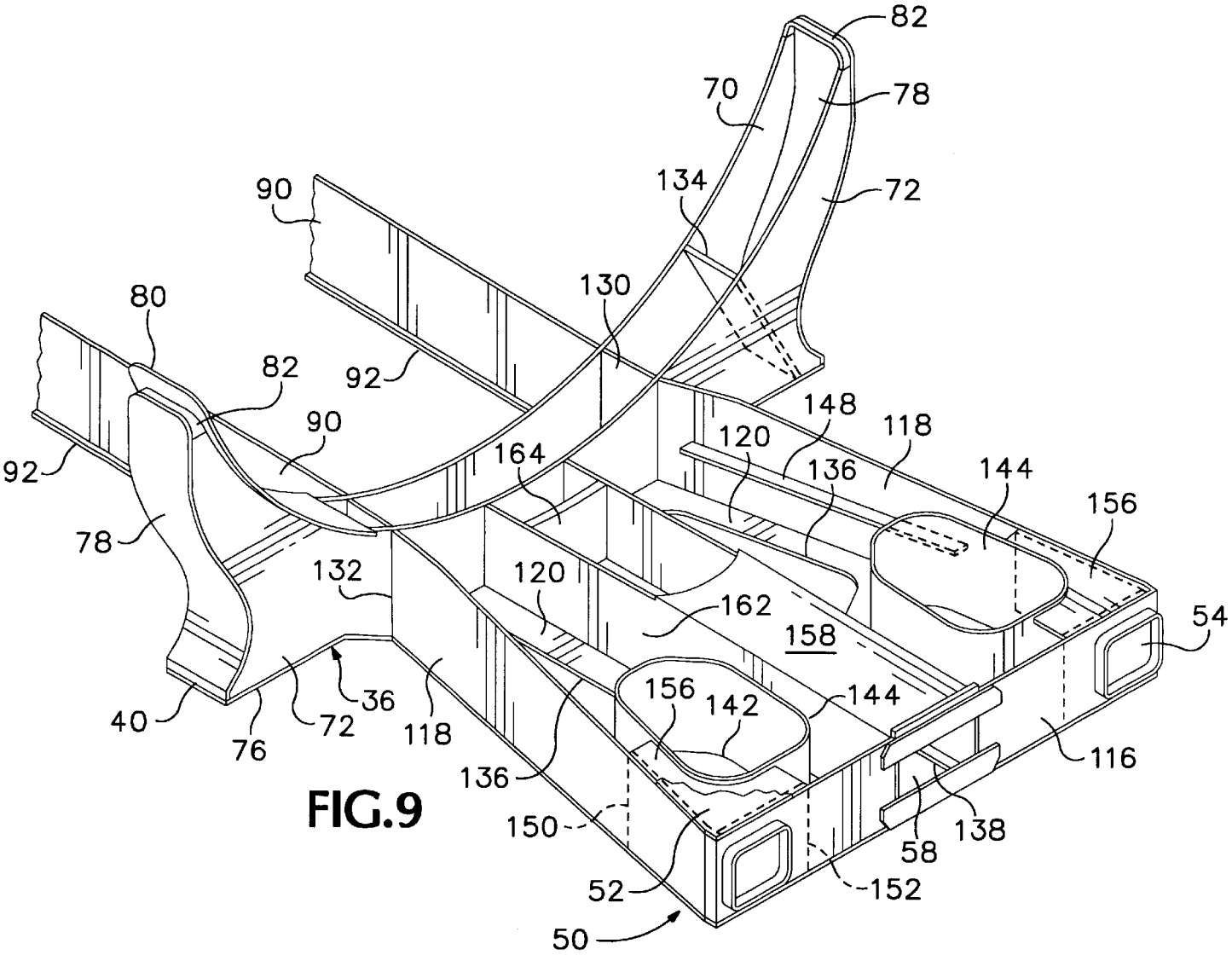
FIG. 9 is an isometric view of the saddle and sill structures shown in FIG. 8 with most of the top shear plate of the stub sill removed to provide a better view of the interior structure of the saddle bolster and stub sill.
Figure 10:
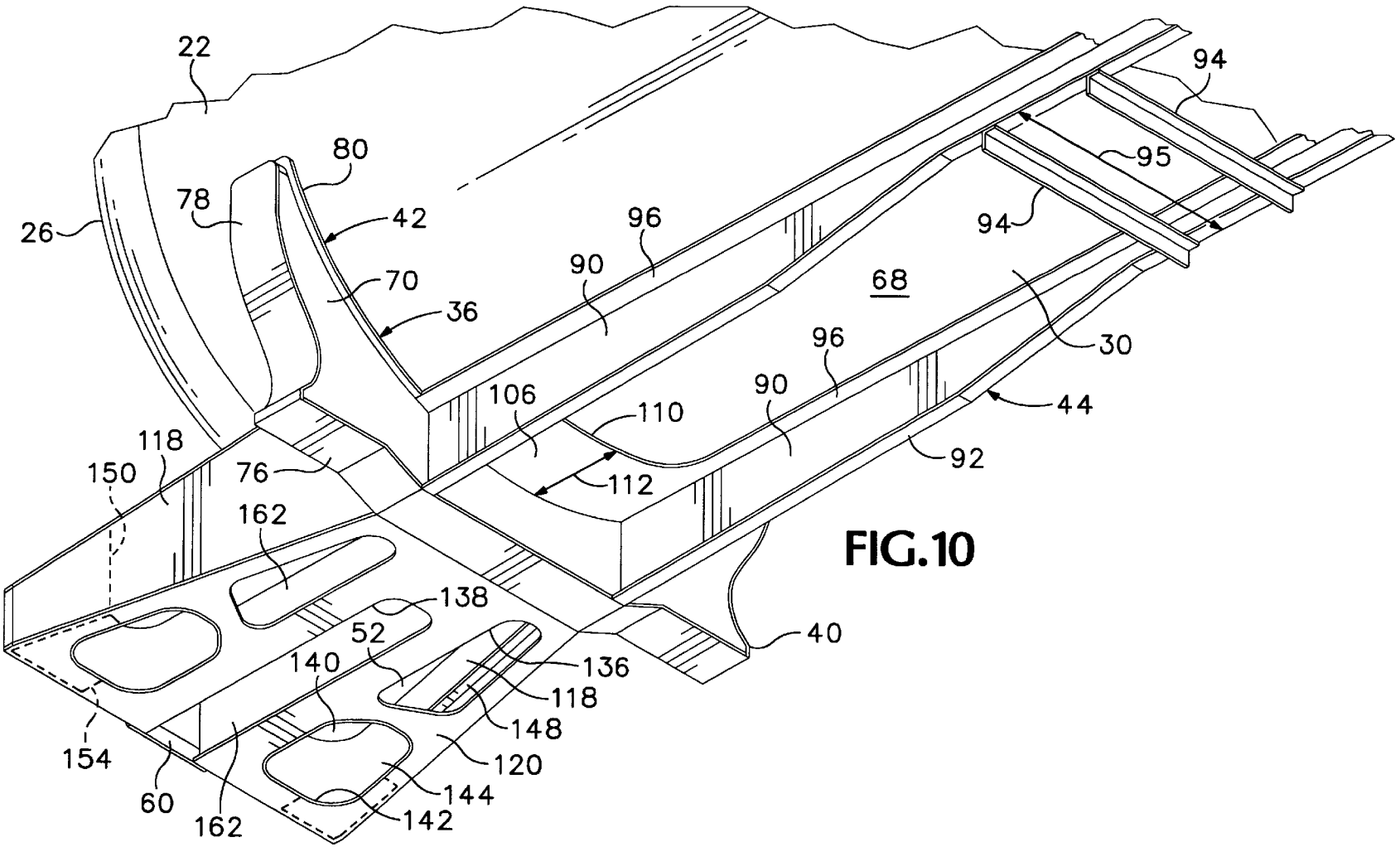
FIG. 10 is an isometric view of a portion of the railroad tank car body shown in FIG. 1, taken from one side of and below a middle part of the car body, looking longitudinally outward toward an end of the car body.

As may be seen in FIG. 9, in which most of the top shear plate 52 is removed from the stub sill 50, longitudinal webs 130 located between the inner and outer plates 70 and 72 are aligned with and extend between the adjacent margins of the webs 90 of the center sill 44 and the inboard margins 132 of the sideplates 118. Additional strengthening webs 134 may be used to interconnect the inner and outer plates 70 and 72 of the saddle bolster 36 or 38 at locations spaced laterally outward from the center sill 44 to support the side bearings between the trucks 24 and the car body 18.

The bottom plate 120 defines a pair of laterally opposite openings 136 and a U-shaped central opening 138 beneath the coupler housing tube 58. Additionally, both the top shear plate 52 and the bottom plate 120 define pairs of correspondingly shaped openings 140 and 142, respectively, which are located above each other and are generally similar. Because the top shear plate 52 is inclined at a small angle with respect to the bottom plate 120, the openings 140 and 142 differ slightly in shape. A respective stiffener sheet 144 which may be an assembly of several flat portions interconnected by arcuately formed partial cylinder portions is connected to both said top shear plate 52 and said bottom plate 120 near, or preferably along, the margins of each set of the openings 140 and 142 and forms a tubular interconnection between the top shear plate 52 and the bottom plate 120. The respective tubular stiffener sheet 144 is welded to both the top shear plate 52 and the bottom plate 120 about the entire periphery of each of the openings 140 and 142 so that each stiffener sheet 144 forms a torsionally stiff box interconnecting the top shear plate 52 and the bottom plate 120. The stiffener sheets 144 may, for example, be of steel plate 4.5 mm in thickness.

It will be understood further that the stiffener sheet 144 could form a tube larger than each or one of the openings 140 and 142, if desired, although one object of the opening 140 and 142 is to reduce the weight of the car 16.

The sideplates 118 are supported along their inner sides by narrow horizontal longitudinally-extending stiffener plates 148 to add rigidity to the stub sill 50. Additionally, doubler plates 150 and 152 are attached respectively to the sideplates 118 and end plates 116 near their intersection with each other at each outer corner of the stub sill 50. A corner fillet doubler 154 is provided for the bottom plate 120 and a similar corner fillet doubler plate is provided for the top shear plate 52 at the outer corners of the stub sill 50.

The coupler tube 58 is of conventional construction and includes a top plate 158 extending horizontally beneath a U-shaped opening 160 defined in the top shear plate 52. The sides of the coupler tube 58 are defined by a pair of parallel longitudinal upright stub sill webs 162 extending from the end sill or plates 116 to the saddle bolster 36 or 38, and a buffer block 164 of conventional design extends transversely between the sideplates 162 at the requisite distance from the striker plate 60.

The described integrated structure of the stub sill 50, saddle bolster 36 or 38, and center sill 44, together with the tank 22, provide a railway tank car 16 whose tare weight is significantly lighter than a railway tank car of similar capacity of traditional European type construction, yet the unified structure of such a railway tank car 16 has ample strength to withstand the stresses resulting from static and dynamic loads imposed by inclusion of the car 16 as part of a train.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad tank car, comprising:

(a) an elongate, generally cylindrical tank having a first end, an oppositely located second end, a top, and a bottom;

(b) a pair of saddle bolsters, one of said saddle bolsters being located proximate each said end of said tank;

(c) a longitudinally extending center sill attached to both of said saddle bolsters, said center sill having a length and interconnecting said saddle bolsters with each other and extending along and in contact with said bottom of said tank and being interconnected with said bottom of said tank along substantially all of said length; and (d) a respective stub sill located adjacent each of said ends and attached to a respective one of said saddle bolsters and extending longitudinally outward beyond a respective one of said ends of said tank, said stub sill fitting matingly against and being attached to a portion of said bottom of said tank located adjacent said respective one of said ends and longitudinally outward from said respective one of said saddle bolsters, and said stub sill extending laterally outward toward each of a pair of sides of said tank car, beyond a width of said center sill.

2. The railroad tank car of claim 1 wherein each of said saddle bolsters includes a pair of parallel vertically and transversely extending plates, each of said plates having an upper margin shaped to fit matingly against an outside surface of said tank and attached to said tank, said plates being spaced apart from each other longitudinally of said car, said plates including respective lower margins interconnected by a bottom plate and respective outer margins interconnected by a side closing plate.

3. The railroad tank car of claim 1, wherein said tank has a longitudinal central axis and each of said saddle bolsters extends around a portion of said bottom of said tank subtending an angle about said central axis of at least 130 degrees.

4. The railroad tank car of claim 1 wherein each of said saddle bolsters includes a pair of parallel vertical plates extending transversely, each of said plates having an upper margin shaped to fit matingly about said tank, and each of said saddle bolsters also including a tank bottom doubler plate attached to and interconnecting said upper margins of said parallel vertical plates and extending longitudinally of said tank car a predetermined distance beyond each of said parallel vertical plates, said tank bottom doubler plate also being attached to said tank and thereby interconnecting said saddle bolster with said tank.

5. The tank car of claim 4 wherein said transverse vertical plates of each of said saddle bolsters are spaced apart from one another by a distance in the range of 240 to 300 mm.

6. The railroad tank car of claim 1 wherein said stub sill has a top shear plate including an inboard margin thereof extending closely along and fixedly interconnected with an outer surface of a portion of said tank located adjacent a respective one of said ends.

7. The railroad tank car of claim 1, including a doubler plate extending along said inboard margin and located between said inboard margin and said outer surface of said portion of said tank, said doubler plate being welded to both said inboard margin and said outer surface and thereby interconnecting said top shear plate with said tank.

8. The railroad tank car of claim 1, said center sill having a width and each said respective stub sill having a respective greater width.

9. The railroad tank car of claim 1, wherein said stub sill extends generally horizontally from said saddle bolster and is generally trapezoidal in plan shape, increasing in width with distance from said saddle bolster, said stub sill including a generally trapezoidal bottom plate and a generally trapezoidal top shear plate, said bottom plate and said shear plate each defining a respective opening, said opening in said top shear plate corresponding in shape and size with said opening in said bottom plate and being located substantially vertically above it, and said stub sill including a stiffener sheet structure interconnecting said bottom plate with said top shear plate and located along respective peripheries of said openings.

10. The railroad tank car of claim 9, wherein said bottom plate is horizontal and is aligned with said bottom chord of said center sill.

11. The railroad tank car of claim 9, wherein each of said bottom plate and said top shear plate defines a pair of said respective openings, one of each said pair being located in each of a pair of opposite lateral side portions of a longitudinally outer portion of said stub sill, and wherein said stiffener sheet structure defines a torsion box surrounding one of said openings in said bottom plate and a corresponding one of said openings in said top shear plate.

12. The underframe of claim 11, wherein said saddle bolsters each include a pair of parallel transverse plates and said center sill includes a bottom chord, and wherein said bottom plate of said stub sill extends beneath said transverse plates of said saddle bolster and is joined to said bottom chord of said center sill.

13. A railroad tank car, comprising:

(a) a pair of saddle bolsters extending transversely of said car;

(b) a center sill structure having a length and extending longitudinally of said car from one of said saddle bolsters to the other, said center sill being interconnected with each of said saddle bolsters;

(c) a stub sill attached to one of said saddle bolsters and extending longitudinally of said car away from said center sill;

(d) an elongate generally cylindrical tank shell having a bottom portion and extending longitudinally of said car, resting on and being fixedly attached to each one of said pair of saddle bolsters and to said stub sill, and said bottom portion of said tank shell being attached fixedly to said center sill substantially continuously along said length of said center sill.

14. The railroad tank car of claim 13, said center sill including an upright web plate extending longitudinally of said car and a doubler plate extending along a top margin of said web plate and welded both to said web plate and to said bottom of said tank shell, said doubler plate and said tank shell thereby being integrated with said center sill.

15. The railroad tank car of claim 14 wherein said center sill includes a generally horizontal bottom chord member fixedly attached to a bottom margin of said upright web plate.

16. An underframe for an elongate railroad tank car having a pair of opposite ends, comprising:

(a) a pair of transverse saddle bolsters each having a respective outer face, an inner face, and an arcuately concave upper surface shaped to correspond matingly with an outer surface of a tank;

(b) a stub sill attached to and extending longitudinally outwardly away from said outer face of one of said saddle bolsters of said pair, said stub sill including:

(i) a pair of upstanding sideplates attached to said outer face and extending away from said outer face divergently and generally longitudinally of said underframe, said sideplates having respective upper and lower margins;

(ii) an upper shear plate fixedly attached to and extending transversely between said upper margins of said sideplates, said upper shear plate including a concavely arcuate inboard margin facing toward said outer face of said saddle bolster;

(iii) a horizontal bottom plate attached to and extending transversely between said lower margins of said sideplates and also being fixedly attached to said saddle bolster, said bottom plate and said upper shear plate each defining a respective opening extending therethrough, said opening in said upper shear plate being aligned with and located above said opening in said bottom plate; and (iv) a stiffener sheet extending between said bottom plate and said top shear plate and fixedly attached to both said bottom plate and said top shear plate adjacent said opening in each; and (c) a center sill attached to and extending longitudinally between said longitudinally inner faces of said saddle bolsters and having an upper surface shaped to fit matingly against said outer surface of said tank.

17. The underframe structure of claim 16 wherein said sideplates of said stub sill have a greater height adjacent said saddle bolster and are tapered to a lesser height at an outer end of said stub sill spaced apart from said saddle bolster, and wherein said top shear plate extends slopingly upward along said upper margins of said sideplates from said outer end.

18. The underframe of claim 16 wherein said stub sill includes a torsion box structure extending between said bottom plate and said top shear plate, said torsion box structure including said stiffener sheet.

19. The underframe of claim 16 wherein said sideplates of said stub sill extend through said saddle bolster to said inner face thereof, and wherein said center sill includes a pair of vertical web plates, each of said web plates being aligned with and joined to a respective one of said sideplates of said stub sill.

20. The underframe of claim 16 wherein said saddle bolster includes a center bearing foundation and a side bearing foundation.

* * * * *

UNITED STATES PATENT AND TRADEMARK OFFICE

CERTIFICATE OF CORRECTION

PATENT NO. : 6,357,363 B1
DATED : March 19, 2002
INVENTOR(S) : Militaru

It is certified that error appears in the above-identified patent and that said Letters Patent is hereby corrected as shown below:

Title page,
Item [75], Inventor, correct as follows -- Militaru --

Signed and Sealed this

Ninth Day of August, 2005

JON W. DUDAS
*Director of the United States Patent and Trademark Office*